United States Patent [19]

Isobe et al.

[11] Patent Number: 4,463,732

[45] Date of Patent: Aug. 7, 1984

[54] ELECTRONIC CONTROLLED NON-SYNCHRONOUS FUEL INJECTING METHOD AND DEVICE FOR INTERNAL COMBUSTION ENGINES

[75] Inventors: Toshiaki Isobe, Nagoya; Naoki Sugita, Toyota, both of Japan

[73] Assignee: Toyota Jidosha Kogyo Kabushiki Kaisha, Toyota, Japan

[21] Appl. No.: 391,431

[22] Filed: Jun. 23, 1982

[30] Foreign Application Priority Data

Mar. 2, 1982 [JP] Japan ..... 57-32843

[51] Int. Cl.[3] ..... F02M 51/00

[52] U.S. Cl. ..... 123/492; 123/491; 123/480

[58] Field of Search ..... 123/478, 480, 491, 492

[56] References Cited

U.S. PATENT DOCUMENTS

| | | | |
|---|---|---|---|
| 3,759,231 | 9/1973 | Endo | 123/492 |
| 3,858,561 | 1/1975 | Aono | 123/492 |
| 4,176,625 | 12/1979 | Stauffer | 123/492 |
| 4,184,461 | 1/1980 | Leung | 123/492 |
| 4,345,561 | 8/1982 | Kondo et al. | 123/478 |
| 4,348,728 | 9/1982 | Sagisaka et al. | 123/480 |
| 4,365,299 | 12/1982 | Kondo et al. | 123/480 |
| 4,389,996 | 6/1983 | Yaegashi et al. | 123/491 |

*Primary Examiner*—Parshoram S. Lall

*Attorney, Agent, or Firm*—Cushman, Darby & Cushman

[57] ABSTRACT

An electronic fuel injecting method and device for an internal combustion engine, wherein a correction in accordance with the operating conditions or the like of the engine is effected on a basic injection time obtained in accordance with an intake pressure or an intake air flowrate, and a rotational speed of the engine, to thereby provide fuel in synchronism with the rotation of the engine. When the operating conditions of the engine reach a predetermined condition, fuel is provided at a predetermined injection time not in synchronism with the rotation of the engine. When requirements for non-synchronous injection take place during synchronous injection, the time period for the synchronous injection is prolonged by the appropriate non-synchronous injection time. When more than one non-synchronous injection requirement occurs during a single synchronous injection, the synchronous injection time is lengthened by a time corresponding to only one of the non-synchronous injection requirements.

7 Claims, 5 Drawing Figures

ELECTRONIC CONTROLLED NON-SYNCHRONOUS FUEL INJECTING METHOD AND DEVICE FOR INTERNAL COMBUSTION ENGINES

BACKGROUND OF THE INVENTION

1. Field of the Invention

This invention relates to an electronic fuel injecting method and device for an internal combustion engine. More particularly, this invention relates to a D-J type electronic fuel injection system, in which fuel is injected in synchronism with the rotation of the engine unless the operating conditions of the engine reach a predetermined condition, in which case fuel is injected at a predetermined injection time which is not in synchronism with the rotation of the engine.

2. Description of the Prior Art

In electronic fuel injection systems, one injector for each cylinder of the engine or one injector for all of the cylinders may be provided, for example, on an intake manifold or a throttle body of the engine. The valve-opening time period of the injectors or injector is controlled in accordance with the operating conditions of the engine, so that a mixture of a predetermined air-fuel ratio can be supplied to the combustion chambers of the engine. Electronic fuel injection systems are broadly divided into two classes including a so-called L-J type electronic fuel injection system wherein a basic injection time is obtained in accordance with an intake air flowrate of the engine and engine rotational speed and a so-called D-J type electronic fuel injection system wherein a basic injection time is obtained in accordance with an intake pressure of the engine and engine rotational speed.

In the L-J systems, fuel is injected at a constant crank angle in synchronism with the rotation of the engine. In response to operating conditions of the engine, a correction during start, a correction after the start, a correction due to intake air temperature, a correction for warming up, a correction for acceleration during warming up, a correction for power, an air-fuel ratio feedback correction and the like are employed to modify a basic injection time calculated in accordance with an intake air flowrate of the engine rotational speed. When the operating conditions of the engine reach a predetermined condition, fuel is injected at a time not in synchronism with the rotation of the engine, separately of the normal synchronous injection, in order to improve starting performance or responsiveness immediately after acceleration or deceleration. This non-synchronous injection is controlled independently of the synchronous injection. For example, injection may be effected twice when a signal of an ignition switch is detected in order to improve the starting performance of the engine. Injection may be effected one time when a full closed signal of a throttle valve is changed from "ON" to "OFF" to improve engine response and exhaust gas purification performance in moving from the engine idling condition. Injection may be effected one time each time an acceleration signal is generated to improve engine response immediately after acceleration and during acceleration. Finally, injection may be effected one time at the time fuel returns after cut off to improve responsiveness at the time fuel returns.

An L-J type electronic fuel injecting system as described above controls the air-fuel ratio with high accuracy and is widely used in engines with which exhaust gas purification measures are taken. However, heretofore, when requirements for non-synchronous injection take place during synchronous injection, the requirements for non-synchronous injection have been ignored, thus occasionally prohibiting satisfactory performance. To obviate the above-described disadvantage, if the requirements for non-synchronous injection take place during synchronous injection, it may be thought that the time period for synchronous injection should be increased by the time period for non-synchronous injection. In this case, however, if a large number of non-synchronous injections would have taken place beyond the necessary number due to a malfunction such as noise, the fuel injection time would become excessive, whereby the air-fuel ratio would become over-rich, thus possibly causing troubles.

In L-J type electronic fuel injection systems, the dynamic range of the intake air flowrate is so wide that the intake air flowrate during high loads is increased to about 50 times that during idling, thereby presenting the following disadvantages. Namely, not only does the accuracy decrease when the intake air flowrate is converted into a digital signal, but also the bit length of the digital lengthens when the counting accuracy in a digital control circuit is improved after conversion, whereby an expensive computer is required for the digital control circuit. Moreover, in order to measure the intake air flowrate, it is necessary to use a precision measuring instrument, thus presenting the disadvantages of requiring a high installation cost.

On the other hand, with D-J type electronic fuel injection systems, the dynamic range of the intake pressure is so narrow that the variation in the intake pressure is as low as two to three times, so that, not only is the operation in the digital control circuit facilitated, but also, a pressure sensor for detecting intake pressure is inexpensive. However, as compared with the L-J type electronic fuel injection system, the D-J type electronic fuel injection system has a low control accuracy of the air-fuel ratio, and consequently, it has been considered difficult to adopt the D-J type electronic fuel injecting devices into engines employed with exhaust gas purification measures, requiring high accuracy airfuel ratio control. It is also conceivable that, in D-J type electronic fuel injection systems, non-synchronous injection, which has been adopted in L-J type electronic fuel injection systems, may be used. However, the same disadvantages encountered with the L-J type electronic fuel injection system exist.

SUMMARY OF THE INVENTION

The present invention has been developed to obviate the above-described disadvantages of the prior art and has as its first object the provision of an electric fuel injecting method for an internal combustion engine, wherein, even if requirements for non-synchronous injection would take place during synchronous injection, non-synchronous injection beyond necessity is not effected, so that the air-fuel ratio can be prevented from becoming over-rich.

A second object of the present invention is to provide an electronic fuel injecting method for an internal combustion engine, wherein the length of prolongation of the synchronous injection time period can be quickly determined by a comparatively simple program.

A third object of the present invention is to provide an electronic fuel injecting method for an internal combustion engine, wherein non-synchronous injection meeting the characteristics required by the engine during acceleration can be effected.

A fourth object of the present invention is to provide an electronic fuel injection device for an internal combustion engine, wherein the above-described objects have been achieved.

To achieve the first object, according to the present invention, when requirements for non-synchronous injection take place during synchronous injection, the time period for the synchronous injection is prolonged by one time period for the non-synchronous injection.

To achieve the second object, according to the present invention, the aforesaid synchronous injection time period is prolonged by one non-synchronous injection time period meeting a first requirement for non-synchronous injection which has taken place during synchronous injection.

To achieve the third object, according to the present invention, a non-synchronous injection time period meeting an acceleration signal generated when the change in value of throttle valve opening in every predetermined time period exceeds a criterion value is made to be a sum of a fixed value and a value variable in accordance with the changing speed of the throttle valve opening.

To achieve the fourth object, according to the present invention, an electronic fuel injection device for an internal combustion engine comprises:

an intake air temperature sensor for detecting the temperature of intake air taken in by an air cleaner;

a throttle sensor including an idle switch for detecting whether a throttle valve is in an idle opening or not and a potentiometer for generating a voltage output proportional to the opening of the throttle valve;

an intake pressure sensor for detecting an intake pressure through a pressure in a surge tank;

an injector for providing fuel to the engine;

a crank angle sensor for outputting a crank angle signal in accordance with a rotation of the engine;

a coolant temperature sensor for detecting the temperature of engine coolant; and a digital control circuit wherein a basic injection time obtained through a map in accordance with an intake pressure fed from the intake pressure sensor and an engine rotational speed obtained from an output from the crank angle sensor is corrected by a correction value in accordance with outputs from the throttle sensor and the coolant temperature sensor and the like, whereby an injector opening time period signal is fed to the aforesaid injector to provide fuel in synchronism with the rotation of the engine. When the operating conditions of the engine reach a predetermined condition, another injector opening time period signal is fed to the aforesaid injector to provide fuel at a predetermined injection time not in synchronism with the rotation of the engine. When requirements for non-synchronous injection take place during synchronous injection, the synchronous injection time period is prolonged by a non-synchronous injection time period, meeting the requirement for non-synchronous injection which has taken place during the synchronous injection time period.

According to the present invention, even if extraneous requirements for non-synchronous injection take place due to a malfunction such as noise, excessive non-synchronous injection is not effected, and the air-fuel ratio is prevented from becoming over-rich. In consequence, particularly when a D-J type electronic fuel injection system is used, the air-fuel ratio control can be carried out with high accuracy.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE INVENTION

Detailed description will hereunder be given of the embodiment of the present invention with reference to the drawings.

Figure 1:
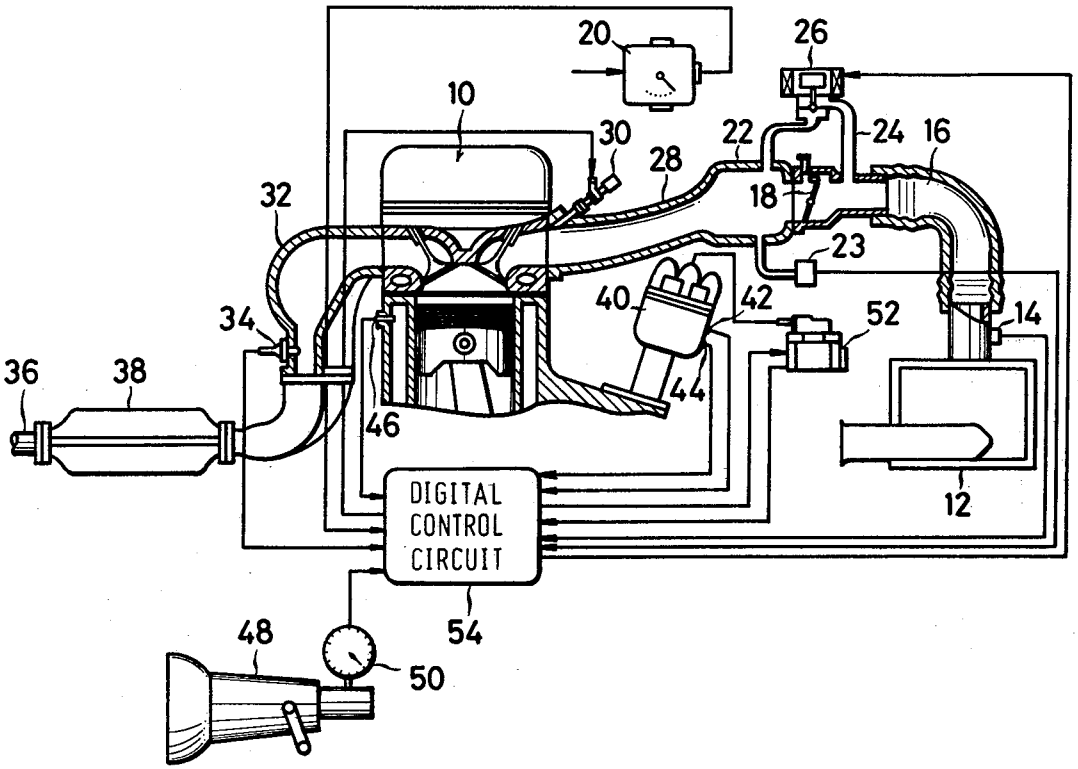
FIG. 1 is a block diagram showing the arrangement of an embodiment of the D-J type electronic fuel injection device for a motor vehicle, to which is applied the electronic fuel injecting method for an internal combustion engine according to the present invention.
Figure 2:
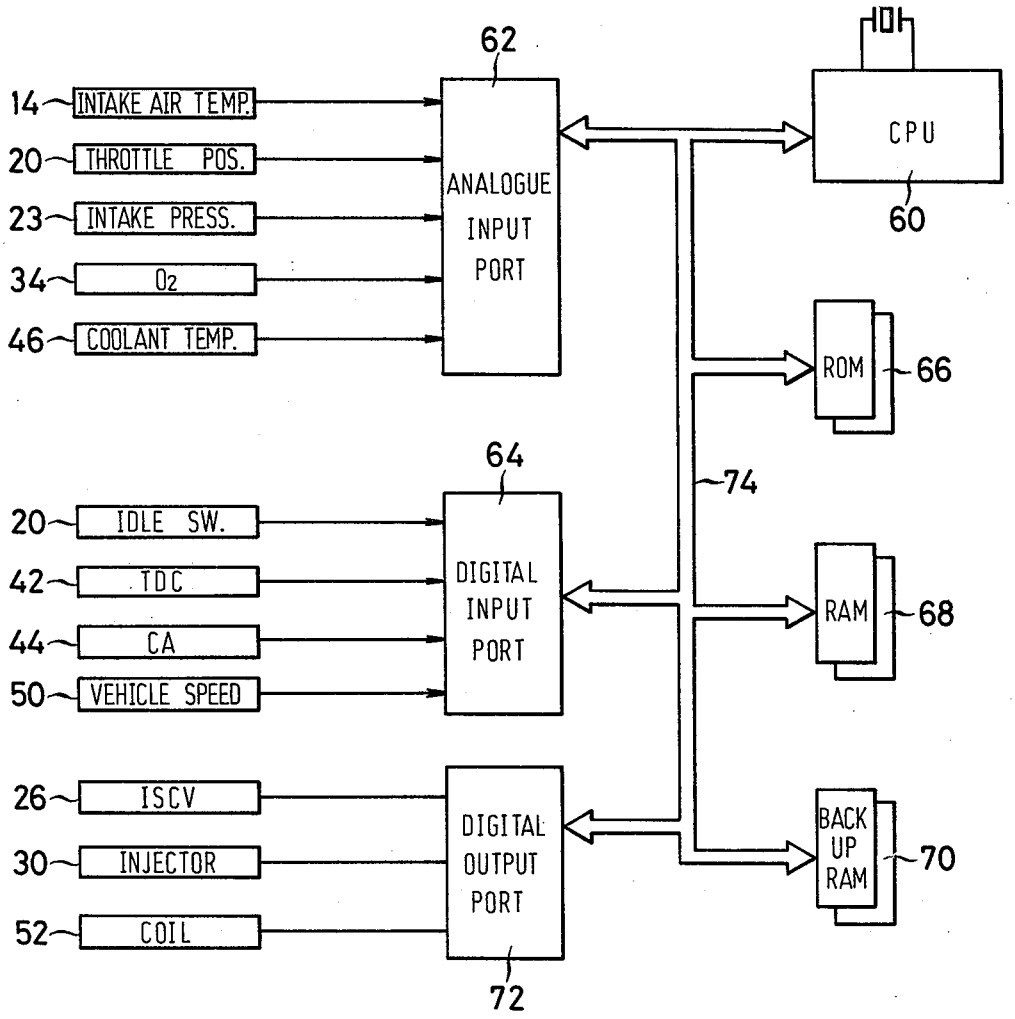
FIG. 2 is a block diagram showing the arrangement of the digital control circuit used in the above-mentioned embodiment.

FIGS. 1 and 2 show one embodiment of a D-J type electronic fuel injection device of an engine 10 of a motor vehicle in accordance with the present invention. An air cleaner 12 takes in air, the temperature of which is detected by an intake air temperature sensor 14. A throttle valve 18, provided in an intake air passage 16, is adapted to be interlocked with an accelerator pedal, not shown, provided around a driver's seat and can be opened or closed to control the flowrate of intake air. A throttle position sensor 20 includes an idle switch for detecting whether the throttle valve 18 is in an idle position and a potentiometer for generating a voltage output proportional to the opening of throttle valve 18. Surge tank 22 is disposed between throttle valve 18 and engine 10. Intake pressure sensor 23 detects the intake pressure in surge tank 22.

A bypass passage 24 interconnects opposite sides of throttle valve 18. An idle speed control valve 26 provided in bypass passage 24 controls the opening area of bypass passage 24 to control the idle rotational speed.

Injector 30 provides fuel into an intake port of engine 10. Oxygen concentration sensor 34, provided on exhaust manifold 32, detects air-fuel ratio from the residual oxygen concentration in the exhaust gas. Three-way catalytic converter 38 is provided at the intermediate portion of an exhaust pipe 36, downstream of exhaust manifold 32.

Distributor 40 has a distributor shaft rotatable in operational association with a crankshaft of the engine 10. Top dead center sensor 42 and a crank angle sensor 44, incorporated in the distributor 40, output a top dead center signal and a crank angle signal in accordance with the rotation of the distributor shaft, respectively.

A coolant temperature sensor 46 is provided on the engine block for detecting the temperature of engine coolants. A vehicle speed sensor 50 detects a running speed of the vehicle from the rotational speed of an output shaft of a transmission 48.

In a digital control circuit 54, a basic injection time per cycle of the engine is obtained from a map in accordance with the intake pressure fed from the intake pressure sensor 23 and the engine rotational speed obtained from an output of the crank angle sensor 44. The basic injection time thus obtained is corrected in accordance with an output from the throttle sensor 20, an air-fuel ratio fed from the oxygen concentration sensor 34, the temperature of engine coolant fed from the coolant temperature sensor 46 and the like to determine a fuel injection time. As a result, an injector opening time signal is fed to the injector 30 to provide fuel in synchronism with the rotation of the engine.

Also, another valve opening time period signal is fed to the injector 30 to provide fuel at a predetermined injection time, which is not in synchronism with the rotation of the engine, when the operating conditions of the engine reach a predetermined operating condition. Ignition timing signal, determined in accordance with the operating conditions of the engine, is fed to a coil 52 provided with an igniter. Finally, idle speed control valve 26 is controlled during idling.

When requirements for non-synchronous injection take place during synchronous injection, the synchronous injection time period is prolonged by a non-synchronous injection period.

As detailed in FIG. 2, the digital control circuit 54 comprises a Central Processing Unit 60 (hereinafter referred to as "CPU") consisting of a microcomputer for performing various operations. An analog input port 62, including a multiplexer, converts analog signals fed from the intake air temperature sensor 14, the potentiometer of the throttle sensor 20, the intake pressure sensor 23, the oxygen concentration sensor 34, the coolant temperature sensor 46 and the like, into digital signals and successively provides them to CPU 60. A digital input port 64 provides CPU 60 with digital signals fed from the idle switch of the throttle sensor 20, the top dead center sensor 42, the crank angle sensor 44, the vehicle speed sensor 50 and the like. A Read Only Memory 66 (hereinafter referred to as "ROM") stores programs, various constants or the like. A Random Access Memory 68 (hereinafter referred to as "RAM") temporarily stores operation data in CPU 60 and the like. A backup Random Access Memory 70 is supplied with current from an auxiliary power source, when the engine is stopped, to hold its contents. A digital output port 72 outputs the results of operations in CPU 60 at predetermined times to the idle speed control valve 26, the injector 30, the coil 52 with the igniter and the like. A common bus 74 interconnects these components to each other.

In operation, the digital control circuit 54 reads out the basic injection time period TP(PM, NE) from the intake pressure PM fed from the intake pressure sensor 23 and the engine rotational speed calculated from an output of the crank angle sensor 44, through a map previously stored in ROM 66.

Subsequently, the basic injection time period TP(PM, NE) is corrected through the following equation in response to signals from the respective sensors so as to calculate a synchronous injection time period TAUSYC.

$$TAUSYC = TP(PM, NE) \times (1 + F) \quad (1)$$

where F is a coefficient of correction which can be negative.

A fuel injection time signal corresponding to the synchronous injection time period TAUSYC thus determined is fed to the injector 30, whereby the injector 30 is opened only for the synchronous injection time period TAUSYC in synchronism with the engine rotation, so that fuel is provided to the intake manifold 28 of the engine 10.

Furthermore, when either (1) a signal from the ignition switch is detected during the start of the engine, (2) a fully closed throttle valve signal is changed from "ON" to "OFF", (3) an acceleration signal is generated during acceleration, or (4) a fully closed throttle valve signal is turned "OFF" to begin supplying fuel after deceleration, fuel is injected at a predetermined injection time not in synchronism with the rotation of the engine, independently of the aforesaid synchronous injection.

Figure 3:
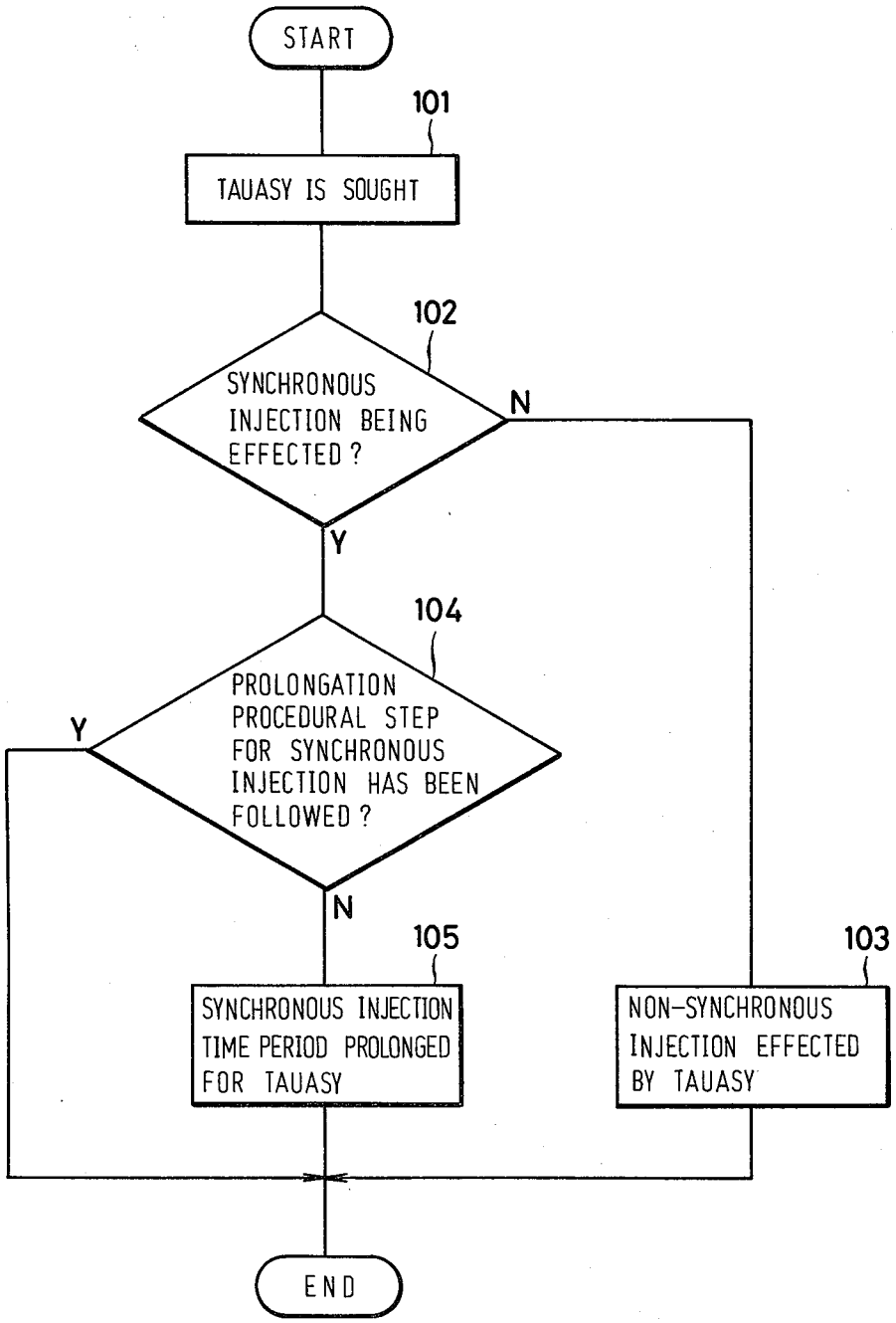
FIG. 3 is a flow chart showing a program for non-synchronous injection used in the above-mentioned embodiment.
Figure 4:
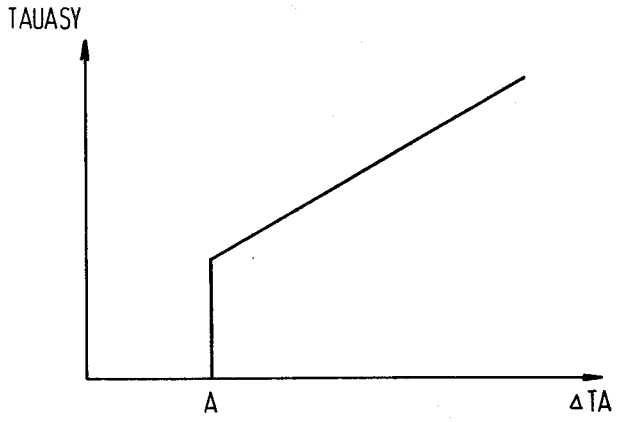
FIG. 4 is a graphic chart showing an example of the relation between the change in value of the throttle valve opening in every predetermined time period and the non-synchronous injection time period, the relation being used in determining the non-synchronous injection in accordance with the change in speed of the throttle valve opening in the above-mentioned embodiment.

More specifically, the process shown in FIG. 3 is performed when a requirement for non-synchronous injection takes place. Firstly, in Step 101, an appropriate non-synchronous injection time period, TAUASY, is sought. For example, when the requirement for non-synchronous injection is in response to an acceleration signal which is generated when a change, ΔTA, of the throttle valve opening TA in a predetermined time period exceeds a criterion value A, an appropriate non-synchronous time period TAUASY is read out of a table of non-synchronous injection time periods for the value ΔTA as shown in FIG. 4. Subsequently, the process goes forward to Step 102, where judgement is made whether the synchronous injection is being effected or not. When the result of judgement is negative, the process goes forward to Step 103, where a fuel injection signal corresponding to the non-synchronous injection time period TAUASY obtained in the preceding Step 101 is fed to the injector 30. As a result, the injector 30 is opened only for the fuel injection time period TAUASY, and fuel is provided to the intake manifold 28 of the engine at a time not in synchronism with the rotation of the engine, thus completing this program.

On the other hand, when the result of judgement in Step 102 is positive, i.e., the requirement for non-synchronous injection takes place during synchronous injection, the process goes forward to Step 104. There, judgement is made whether the procedural step for prolongation of the synchronous injection has been followed or not. When the result of judgement is negative, the process goes forward to Step 105, where the aforesaid synchronous injection time period TAUSYC obtained is prolonged for a non-synchronous injection time period TAUASY obtained in Step 101 to prolong the synchronous injection, thus completing this program.

On the other hand, when the result of judgement in Step 104 is positive, i.e., the requirement for non-synchronous injection is the second or later requirement for non-synchronous injection during synchronous injection, the synchronous injection time period TAUSYC is not further prolonged, thus completing this program as it is.

Figure 5:
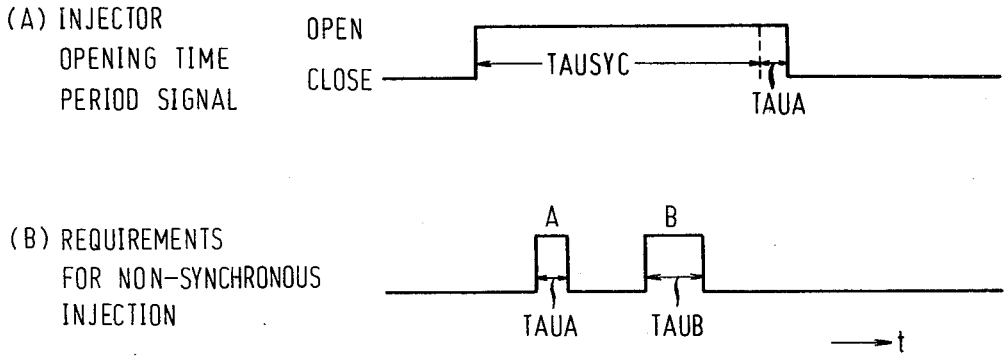
FIG. 5 is a graphic chart showing the pattern of the prolongation of the synchronous injection time period due to requirements for non-synchronous injection during synchronous injection in the above-mentioned embodiment.

FIG. 5 shows the relation between the injector opening time period signal of the injector 30 and the time at which the requirement for non-synchronous injection has taken place. As apparent from FIG. 5, the synchronous injection time period TAUSYC is prolonged only for a non-synchronous injection time period TAUA corresponding to a requirement A for non-synchronous injection which has taken place first during synchronous injection. The prolongation of the non-synchronous injection time period TAUB, corresponding to a requirement B for non-synchronous injection which is a second or later requirement, is not effected to eliminate excessively rich air-fuel mixtures being provided to the engine due to erroneous non-synchronous injection requirements generated by noise or the like.

As has been described hereinabove, the synchronous injection time period is prolonged only for the non-synchronous injection time period corresponding to the first requirement for non-synchronous injection, which has taken place during synchronous injection, so that a suitable increase correction can be effected regardless of whether a requirement for non-synchronous injection occurs due to a malfunction such as noise.

In this embodiment, the synchronous injection time period is prolonged for one non-synchronous injection time period corresponding to the first requirement for non-synchronous injection, which has taken place during synchronous injection, so that the prolongation time period of the synchronous injection time period can be quickly determined by a comparatively simple program. However, other alternatives are within the scope of this invention. For example, the time period for every non-synchronous requirement occurring during a single synchronous injection may be stored. The synchronous injection may then be prolonged by the longest one of the non-synchronous time periods thus stored.

Additionally, in this embodiment, non-synchronous injection in response to an acceleration signal is not effected when the value $\Delta TA$ is less than the criterion value A as shown in the aforesaid FIG. 4. When the change in value $\Delta TA$ exceeds the aforesaid criterion value A, the amount of fuel asynchronously provided is equal to a sum of the fixed value and the value variable in accordance with the changing speed, so that non-synchronous injection meeting the required characteristics of the engine during acceleration can be effected.

The above-described embodiment of the present invention is applied to a D-J type electronic fuel injection system. It should be understood, however, that there is no intention to limit the scope of application of the invention to this. In fact, the invention is applicable to an internal combustion engine having an L-J type electronic fuel injection system or other electronic fuel injection system.

It should be apparent to those skilled in the art that the above-described embodiment are merely representative, which represents the application of the principles of the present invention. Numerous and varied other arrangements can be readily devised by those skilled in the art without departing from the spirit and the scope of the invention.

What is claimed is:

1. Electronic controlled non-synchronous fuel injecting method for an internal combustion engine comprising the steps of:

detecting a plurality of engine conditions;

determining, in response to a first set of said plurality of engine conditions, a synchronous fuel injection time for providing fuel to said engine in synchronism with the rotation of said engine;

detecting, in response to a second set of said plurality of engine conditions, whether a non-synchronous injection is indicated and generating a non-synchronous injection indication in response thereto;

determining a non-synchronous fuel injection time, in response to said non-synchronous injection indication, for providing fuel to said engine not in synchronism with the rotation of said engine;

determining whether a plurality of non-synchronous injection indications are generated during a single synchronous fuel injection;

increasing said synchronous fuel injection time by one of said non-synchronous fuel injection time when a single non-synchronous injection indication is generated during a single synchronous injection and said non-synchronous fuel injection time corresponding to only a single one of said non-synchronous injection indications when a plurality of non-synchronous injection indications are generated during a single synchronous injection; and providing fuel to said engine in accordance with one of: (a) said synchronous fuel injection time when no non-synchronous injection indications are generated during said synchronous injection; (b) said non-synchronous fuel injection time when said non-synchronous injection indication is not generated during a synchronous injection; and (c) said increased synchronous fuel injection time when at least one non-synchronous injection indication is generated during said synchronous injection.

2. A method as set forth in claim 1, wherein said increasing step increases said synchronous fuel injection time by said non-synchronous fuel injection time corresponding to a first non-synchronous injection indication occurring during a single synchronous injection.

3. A method as set forth in claim 1, wherein said increasing step increases said synchronous fuel injection time by the longest one of said non-synchronous fuel injection times corresponding to non-synchronous injection indications occurring during a single synchronous injection.

4. A method as set forth in any one of claims 1, 2 and 3, wherein said non-synchronous injection indication generating step generates said non-synchronous injection indication when an ignition switch is turned "ON", a fully closed throttle valve signal is changed from "ON" to "OFF", an acceleration signal takes place, or fuel cut-off is stopped.

5. A method as set forth in claim 4, wherein said acceleration signal takes place when a change in value of the throttle valve opening in a predetermined time period exceeds a criterion value.

6. A method as set forth in claim 5, wherein said non-synchronous fuel injection time corresponding to said acceleration signal is a value variable in accordance with the changing speed of the throttle valve opening.

7. An electronic controlled non-synchronous fuel injection device for an internal combustion engine comprising:

an intake air temperature sensor for detecting the temperature of air taken into said engine;

a throttle sensor including an idle switch for detecting whether a throttle valve is in an idle opening or not and a potentiometer for generating a voltage output proportional to the opening of the throttle valve;

an intake pressure sensor for detecting the pressure after said throttle valve;

at least one injector for providing fuel to the engine;

a crank angle sensor for outputting a crank angle signal in accordance with a rotation of the engine;

a coolant temperature sensor for detecting the temperature of engine coolant; and digital control circuit mean for: (1) determining a basic injection time from a map in accordance with an intake pressure fed from the intake pressure sensor and an engine rotational speed obtained from an output from the crank angle sensor, (2) correcting said basic time in response to an output from at least said throttle sensor and coolant temperature sensor, (3) feeding said corrected basic time to said injector to provide fuel in synchronism with the rotation of the engine, (4) feeding another injector opening time signal to said injector provide fuel at a predetermined injection time not in synchronism with the rotation of the engine when operating conditions of the engine reach a predetermined condition resulting in a requirement for non-synchronous injection, and (5) when a plurality of said requirements for non-synchronous injection take place during a single synchronous injection, increasing said corrected basic time by said another injector opening time corresponding to only one of said requirements for non-synchronous injection which has taken place during said single synchronous injection.

* * * * *